US006447671B1

(12) United States Patent
Morel et al.

(10) Patent No.: US 6,447,671 B1
(45) **Date of Patent: *Sep. 10, 2002**

(54) PROCESS FOR CONVERTING HEAVY PETROLEUM FRACTIONS, COMPRISING AN EBULLATED BED HYDROCONVERSION STEP AND A HYDROTREATMENT STEP

(75) Inventors: Frédéric Morel, Francheville; Stéphane Kressmann, Serezin du Rhone; Jean-Luc Duplan, Irigny, all of (FR)

(73) Assignee: Institut Francais du Petrole (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,167

(22) Filed: Mar. 24, 2000

(30) Foreign Application Priority Data

Mar. 25, 1999 (FR) ..... 99 03853

(51) Int. Cl.[7] ..... C10G 65/02; C10G 45/00
(52) U.S. Cl. ..... 208/89; 208/58; 208/210
(58) Field of Search ..... 208/84, 58, 210

(56) References Cited

U.S. PATENT DOCUMENTS

| | | | | | |
|---|---|---|---|---|---|
| 1,948,296 | A | | 2/1934 | Haylett | 208/4 |
| 2,081,473 | A | | 5/1937 | Bray et al. | 208/304 |
| 2,587,643 | A | | 3/1952 | Myers | 208/304 |
| 2,882,219 | A | | 4/1959 | Johnson et al. | 208/86 |
| 3,278,415 | A | | 10/1966 | Doberenz et al. | 137/875 |
| 3,331,394 | A | | 7/1967 | Hefler et al. | 208/45 |
| 3,905,892 | A | * | 9/1975 | Gregoli et al. | 208/89 |
| 4,102,779 | A | | 7/1978 | Hensley, Jr. | 208/211 |
| 4,158,622 | A | | 6/1979 | Schwarzenbek | 208/177 |
| 4,344,840 | A | | 8/1982 | Kunesh | 208/59 |
| 4,591,426 | A | * | 5/1986 | Krasuk et al. | 208/96 |
| 4,695,370 | A | | 9/1987 | Galtier et al. | 208/113 |
| 4,715,946 | A | | 12/1987 | LePage et al. | 71/87 |
| 4,959,334 | A | | 9/1990 | Mauleon et al. | 502/43 |
| 4,965,232 | A | | 10/1990 | Mauleon et al. | 502/43 |
| 5,120,691 | A | | 6/1992 | Pontier et al. | 502/44 |
| 5,286,690 | A | | 2/1994 | Hoffmann et al. | 208/113 |
| 5,324,696 | A | | 6/1994 | Bonifay et al. | 502/43 |
| 5,344,554 | A | | 9/1994 | Pontier et al. | 208/164 |
| 5,449,496 | A | | 9/1995 | Pontier et al. | 422/144 |
| 6,007,703 | A | | 12/1999 | Morel | 208/210 |
| 6,207,041 | B1 | * | 3/2001 | Morel et al. | 208/89 |

FOREIGN PATENT DOCUMENTS

| | | |
|---|---|---|
| DE | 2 042 184 | 3/1971 |
| EP | 184 517 | 6/1986 |
| EP | 323 297 | 7/1989 |
| EP | 485 259 | 5/1992 |
| FR | 2 753 984 | 4/1998 |
| FR | 2 764 902 | 12/1998 |
| FR | 2 769 635 | 4/1999 |

* cited by examiner

*Primary Examiner*—Thuan D. Dang
(74) *Attorney, Agent, or Firm*—Millen, White, Zelano & Branigan, P.C.

(57) ABSTRACT

The invention concerns a process for converting a hydrocarbon fraction with a sulphur content of at least 0.1% by weight, an initial boiling point of at least 340° C. and an end point of at least 440° C., characterized in that it comprises the following steps:

a) treating the hydrocarbon feed in a treatment section in the presence of hydrogen, said section comprising at least one three-phase reactor, containing at least one ebullated bed hydroconversion catalyst and operating in liquid and gas upflow mode;

b) sending at least a portion of the effluent from step a) to a section for eliminating catalyst particles contained in said effluent;

c) sending at least a portion of the effluent from step b) to a treatment section, treatment being carried out in the presence of hydrogen and optionally a hydrocarbon fraction from a fixed bed hydrotreatment step.

53 Claims, 5 Drawing Sheets

PROCESS FOR CONVERTING HEAVY PETROLEUM FRACTIONS, COMPRISING AN EBULLATED BED HYDROCONVERSION STEP AND A HYDROTREATMENT STEP

The present invention relates to refining and converting heavy hydrocarbon fractions also comprising sulphur-containing impurities. More particularly, it relates to a process for converting at least a portion of a hydrocarbon feed, for example a vacuum residue obtained from straight run distillation of a crude oil into good quality light gasoline and gas oil fractions and to a heavier product which can be used as a feed for catalytic cracking in a fluidised bed catalytic cracking unit comprising a double regeneration system and optionally a system for cooling the catalyst in the regeneration step. The present invention also relates to a process for producing gasoline and/or gas oil comprising at least one fluidised bed catalytic cracking step.

One aim of the present invention is to produce readily upgradeable lighter fractions such as middle distillates (engine fuel: gasoline and gas oil) and base stock from certain particular hydrocarbon fractions which will be described in more detail below, by partial conversion of those fractions.

Within the context of the present invention, the conversion of the feed to lighter fractions is normally in the range 10% to 75% or even 100% if the unconverted heavy fraction is recycled, usually in the range 25% to 60%, or limited to about 50%.

Feeds which can be treated by the process of the present invention are atmospheric residues or straight run vacuum residues, deasphalted residues, residues from a conversion process such as those from coking, fixed bed hydroconversion such as those from HYVAHL® processes for treating heavy hydrocarbons developed by the Applicant, or heavy hydrocarbon hydrotreatment processes carried out in an ebullated bed such as those from H-OIL® processes, or solvent deasphalted oils, for example using propane, butane or pentane, or asphalts normally originating from deasphalting straight run vacuum residues or vacuum residues from H-OIL® or HYVAHL® processes diluted by hydrocarbon fraction or a mixture of hydrocarbon fractions selected from the group formed by a light cycle oil (LCO), a heavy cycle oil (HCO), a decanted oil (DO), a slurry and gas oil fractions in particular those obtained by vacuum distillation known as vacuum gas oil (VGO). The feeds can also be formed by mixing those various fractions in any proportions, in particular atmospheric residues and vacuum residues. They can also contain gas oil cuts and heavy gas oil cuts originating from catalytic cracking, generally with a distillation range of about 150° C. to about 370° C. or 600° C. or more than 600° C. They can also contain aromatic extracts obtained from manufacturing lubricating oils. In accordance with the present invention, the feeds which can be treated are preferably atmospheric residues or vacuum residues, or mixtures of such residues.

The aim of the present invention is to produce good quality products particularly with a low sulphur content under relatively low pressure conditions, so as to limit the cost of plant. This process can produce a gasoline type engine fuel containing less than 100 ppm by weight of sulphur thus satisfying the most strict regulations governing sulphur content for this type of fuel, from a feed which may contain more than 3% by weight of sulphur. Similarly, and this is of particular importance, a diesel type engine fuel is obtained with a sulphur content of less than 500 ppm and a residue with an initial boiling point of about 370° C., for example, which can be sent as a feed or part of a feed to a residue catalytic cracking step such as a double regeneration step.

The prior art includes descriptions, in particular in United States patents U.S. Pat. Nos. 4,344,840 and 4,457,829, of processes for treating heavy hydrocarbon feeds comprising a first treatment step carried out-in the presence of hydrogen in a reactor containing an ebullated catalyst bed followed by a second fixed bed hydrotreatment step. Those descriptions illustrate the case of fixed bed treatment, in the second step, of a light gas fraction from the product from the first step. It has now been discovered, and this forms one of the aspects of the present invention, that it is possible to use a second step to treat either the whole of the product from the first ebullated bed conversion step or a liquid fraction from this step by recovering the gas fraction converted in the first step under favourable conditions leading to good stability of the system as a whole and to improved middle distillate selectivity. There are other processes for treating heavy hydrocarbon fractions. Thus the Applicant's French, United States and European patents FR-A-2 480 7773, U.S. Pat. No. 4,391,700, FR-A-2 480 774, EP-A-0 113,283, EP-A-0 113 284 and EP-A-0 297 950 describe processes for converting heavy feeds comprising a thermal conversion step, usually termed the hydrovisbreaking step and one or more catalytic steps. Those processes have the disadvantage of forming, in the thermal conversion step, a large quantity of olefinic compounds which then risk clogging the catalyst used in a subsequent step and accelerate its deactivation. A process is also known wherein moving bed treatment is followed by a step for treating the effluent leaving the moving bed in a fixed bed reactor. This type of process is, for example, described by SHELL in the article entitled "The SHELL residue hydroconversion process: development and achievements" presented at the ACS 213$^{th}$ National Meeting, San Francisco, Apr. 13–17, 1997, or by the OCR process from CHEVRON using a counter-current moving bed described in the article entitled "On line catalyst replacement, OCR" published in the Oil and Gas Journal, Oct. 12, 1992, pages 52 to 54. Processes from the Institut Francais du Pétrole which were, for example, presented at the NPRA annual meeting, Mar. 17–19, 1991 can also be cited, which use either moving beds or guard reactors in parallel (swing reactors). All of those processes have the drawback of residue conversions which are limited because of the moving bed technology itself whereby the average reaction temperatures reached are not as high as in processes using an ebullated bed.

In its broadest sense, the present invention is defined as a process for converting a hydrocarbon feed containing at least a hydrocarbon fraction with a sulphur content of at least 0.1% by weight, normally at least 2% and usually at least 4% by weight, and an initial boiling point of at least 340° C., normally at least 500° C., and an end point of at least 440° C., usually at least 600° C., and which can be more than 700° C., characterized in that it comprises the following steps:

a) treating said hydrocarbon feed in a section for treatment carried out in the presence of hydrogen, said section comprising at least one three-phase reactor, containing at least one hydroconversion catalyst, wherein the mineral support is at least partially amorphous, in an ebullated bed, operating in liquid and gas upflow mode, said reactor comprising at least one means (17) for withdrawing catalyst from said reactor located close to the reactor bottom and at least one means (16) for supplying fresh catalyst to said reactor located close to the top of said reactor;

b) sending at least a portion, usually the whole, of the effluent from step a) to a section for eliminating catalyst particles contained in said effluent, said section comprising at least one means for eliminating said solid particles and at least one means for recovering an effluent containing fewer solid particles than the effluent from step a);

c) sending at least a portion, usually the whole, of the effluent from step b) to a treatment section, said treatment being carried out in the presence of hydrogen and optionally a fraction of hydrocarbons added to the effluent from step b), said section comprising at least one reactor containing at least one fixed bed hydrotreatment catalyst wherein the mineral support is at least partially amorphous, under conditions enabling an effluent to be obtained with a reduced sulphur content and a high middle distillate content.

Usually, addition of a hydrocarbon fraction to the effluent from step b) enables the temperature of the fluid entering the treatment section for step c) to be readily adjusted. This hydrocarbon fraction can, for example, be selected from the group formed by VGO, LCO and mixtures of VGO and LCO, in particular a VGO fraction and/or an LCO fraction of the hydrocarbon feed which is treated within the context of the present invention.

Normally the treatment section of step a) comprises one to three reactors in series; the section for eliminating catalyst particles of step b) comprises at least one and usually at least two means for eliminating said solid particles which usually function in an alternating manner or in series; and the treatment section of step c) comprises one to three reactors in series.

In a normal implementation of the invention, at least part, normally all, of the effluent obtained in step c) is sent to a distillation zone (step d)) from which a gas fraction, a gasoline type engine fuel fraction, a gas oil type engine fuel fraction and a liquid fraction which is heavier than the gas oil type fraction are normally recovered.

In a variation, the liquid fraction which is heavier than the hydroconverted feed from step d) is sent to a catalytic cracking section(step e)) in which it is treated under conditions which produce a gas fraction, a gasoline fraction, a gas oil fraction and a fraction which is heavier than the gas oil fraction, usually termed a slurry fraction.

In a further variation, at least a portion of the liquid fraction which is heavier than the hydroconverted feed from step d) is returned either to ebullated bed hydroconversion step a) or to the fixed bed hydrotreatment step c), or in part to each of these steps. It is also possible to recycle the whole of this fraction. At least a portion of the liquid fraction which is heavier than the hydrotreated feed obtained in step d) can also be sent to the heavy fuel storage zone, known in the art as the heavy fuel pool.

The gas fraction obtained in steps d) or f) normally principally contain saturated and unsaturated hydrocarbons containing 1 to 4 carbon atoms in their molecule (such as methane, ethane, propane, butanes, ethylene, propylene, butylenes). At least part, preferably all, of the gasoline type fraction obtained in step d) is, for example, sent to the fuel storage zone known in the art as the fuel pool. At least part, preferably all, of the gas oil type fraction obtained in step d) is, for example, sent to the fuel storage zone. At least part, preferably all, of the slurry fraction obtained in step e) is usually sent to the heavy fuel pool in the refinery, generally after separating fine particles which are suspended in it. In a further implementation of the invention, at least part, preferably all, of this slurry fraction is returned to inlet to catalytic cracking step e). In a further embodiment of the invention, at least a portion of this slurry fraction can be returned, generally after separating fine particles suspended in it, either to step a), or to step c), or partially to each of these steps.

One particular embodiment of the present invention comprises an intermediate step al) between step a) and step b) in which the product from step a) is split into a heavy liquid fraction containing the majority of the catalyst particles initially present in the product from step a) and into a lighter fraction containing few or no catalyst particles which is recovered. In this implementation of the present invention, the heavy liquid fraction obtained in this step a1) is then sent to step b) for eliminating solid catalyst particles. This implementation enables light cuts obtained from hydroconversion step a) to be upgraded more easily and limits the quantity of product to be treated in step b). This lighter fraction obtained in step a1) can be sent to a distillation zone from which a gas fraction, a gasoline type engine fuel fraction, a gas oil type engine fuel fraction and a liquid fraction which is heavier than the gas oil type fraction can be recovered, at least part of which can, for example, be returned to step a) and/or be returned to converting hydrotreatment step c). The distillation zone in which this lighter fraction is split can be distinct from the distillation zone of step d), but usually this lighter fraction is sent to the distillation zone for said step d).

By way of example, solid catalyst particles can be separated in step b), these solid particles usually being the fines produced by mechanical degradation of the catalyst used in hydroconversion step a), using at least one rotary filter or at least one basket filter or a centrifuging system such as a hydrocyclone associated with filters, or in-line decanting. The scope of the invention also encompasses carrying out direct separation of the solid catalyst particles contained in the product from step a1) by sending the product which is concentrated in fines to step b), involving the treatment of a smaller quantity of product if separation is carried out on a liquid fraction from step a1) when this step exists. In a particular implementation of this step b), at least two separation means are used in parallel one of which is used to carry out separation while the other is being purged of retained fines.

The conditions for step a) for treating the feed in the presence of hydrogen are usually conventional ebullated bed hydroconversion conditions for a liquid hydrocarbon feed. The operating conditions are normally an absolute pressure of 2.5 to 35 MPa, normally 5 to 25 MPa and usually 6 to 20 MPa at a temperature of about 330° C. to about 550° C. and usually about 350° C. to about 500° C. The hourly space velocity (HSV) and the hydrogen partial pressure are important factors which are selected as a function of the characteristics of the product to be treated and of the desired conversion. The HSV is usually in a range from about 0.1 $h^{-1}$ to about 10 $h^{-1}$, preferably about 0.2 $h^{-1}$ to about 5 $h^{-1}$. The quantity of hydrogen mixed with the feed is normally about 50 to about 5000 normal cubic meters ($Nm^3$) per cubic meter ($m^3$) of liquid feed and usually about 100 to about 1000 $Nm^3/m^3$ and preferably about 200 to about 500 $Nm^3/m^3$. A conventional granular hydroconversion catalyst can be used comprising, on an amorphous support, at least one metal or metal compound having an hydrodehydrogenating function. This catalyst can be a catalyst comprising group VIII metals, for example nickel and/or cobalt, usually in combination with at least one group VIB metal, for example molybdenum and/or tungsten. As an example, it is possible to use a catalyst comprising 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide ($MoO_3$) on an amorphous mineral support. This support is, for example, selected from the group formed by alumina, silica, silica-aluminas, magnesia, clays and mixtures of at least two of these minerals. This support can also comprise other compounds, for example oxides selected from the group formed by boron oxide, zirconia, titanium oxide, or phosphorous pentoxide. Usually, an alumina support is used, and more usually an alumina support doped with phosphorous and optionally boron. The concentration of phosphorous pentoxide $P_2O_5$ is normally less than about 20% by weight and usually less than about 10% by weight. This concentration of $P2O_5$ is normally at least 0.001% by weight. The concentration of boron trioxide $B2O_3$ is normally about 0 to about 10% by weight. The alumina used is normally a γ or η alumina. This catalyst is usually in the form of extrudates.

The total content of oxides of metals from groups VI and VIII is usually about 5% to about 40% by weight, and in general about 7% to 30% by weight and the weight ratio, expressed as the metallic oxide, of the group VI metal (or metals) over the group VIII metal (or metals) is in general about 20 to about 1, usually about 10 to about 2. Part of the used catalyst is replaced with fresh catalyst by withdrawal from the bottom of the reactor and introducing fresh or new catalyst to the top of the reactor at regular intervals, i.e., batchwise or quasi-continuously. As an example, fresh catalyst can be introduced every day. The ratio for replacing used catalyst with fresh catalyst can, for example, be about 0.05 kilograms to about 10 kilograms per cubic meter of feed. This withdrawal and replacement are carried out using apparatus enabling continuous operation of this hydroconversion step. The unit normally comprises a recirculating pump enabling the catalyst to be kept under ebullated bed conditions by continuously recycling at least a portion of the liquid withdrawn from the top of the reactor and reinjected into the reactor bottom. It is also possible to send the used catalyst withdrawn from the reactor to a regeneration zone in which the carbon and sulphur which it comprises are eliminated, then returning the regenerated catalyst to hydroconversion step a).

This hydroconversion step a) is usually carried out under the conditions of the H-OIL® process as described, for example, in the article published by the NPRA Annual Meeting, March 16–18, 1997, J. J. Colyar and L. I. Wilson, entitled "The H-Oil process, a worldwide leader in vacuum residue hydroprocessing".

In the variation mentioned above (step a1)), the products obtained during this step a) are, sent to a separation zone from which a heavy liquid fraction and a lighter fraction are recovered. Normally, the initial boiling point of this heavy liquid fraction is about 280° C. to about 570° C., preferably about 350° C. to about 520° C., for example about 400° C. The lighter fraction is normally used in a separation zone in which it is split into light gasoline and gas oil fractions at least a part of which can be sent to fuel storage zones, and into a heavier fraction.

In hydrotreatment step c), a conventional hydrotreatment catalyst is usually used, preferably at least one of those described by the Applicant, in particular one of those described in patents EP-B-0 113 297 and EP-B-0 113 284. generally, an absolute pressure of about 2 to 35 MPa is used, normally about 5 to 25 MPa and usually about 6 to 20 MPa. The temperature in this step b) is generally about 300° C. to about 500° C., normally about 350° C. to about 450° C. and usually about 350° C. to about 420° C. This temperature is normally adjusted depending on the desired level of hydrodesulphurisation. The hourly space velocity (HSV) and the hydrogen partial pressure are important factors which are selected as a function of the characteristics of the product to be treated and of the desired conversion. The HSV is usually in a range from about 0.1 $h^{-1}$ to about 5 $h^{-1}$, preferably about 0.2 $h^{-1}$ to about 2 $h^{-1}$. The quantity of hydrogen mixed with the feed is normally about 100 to about 5000 normal cubic meters ($Nm^3$) per cubic meter ($m^3$) of liquid feed, usually about 200 to about 2000 $Nm^3/m^3$ and preferably about 300 to about 1500 $Nm^3/m^3$. It is normally carried out in the presence of hydrogen sulphide and the partial pressure of hydrogen sulphide is by about 0.002 times to about 0.1 times, preferably about 0.005 times to about 0.05 times the total pressure. In the hydrodesulphurisation zone, the ideal catalyst must have a strong hydrogenating power in order to carry out deep refining of the products and to obtain a substantial reduction in sulphur content. In the preferred implementation, the hydrotreatment zone is operated at a relatively low temperature which tends in the direction of deep hydrogenation and limitation of coking. The scope of the present invention encompasses using a single catalyst or a plurality of different catalysts in the hydrotreatment zone, simultaneously or successively. Normally this step c) is carried out on an industrial scale in one or more reactors in liquid downflow mode.

In the hydrotreatment zone (step c)), at least one fixed bed of conventional hydrotreatment catalyst is used, the support of which is at least partially amorphous. Preferably, a catalyst is used with a support which is, for example, selected from the group formed by alumina, silica, silica-aluminas, magnesia, clays and mixtures of at least two of these minerals. This support can also comprise other compounds, for example oxides selected from the group formed by boron oxide, zirconia, titanium oxide and phosphorous pentoxide. Usually, an alumina support is used, more specifically an alumina support doped with phosphorous and possibly boron. The concentration of phosphorous pentoxide $P_2O_5$ is normally less than about 20% by weight and usually less than about 10% by weight. This concentration of $P_2O_5$ is normally at least 0.001% by weight. The concentration of boron trioxide $B_2O_3$ is normally about 0 to about 10% by weight. The alumina used is normally a γ or a η alumina. This catalyst is usually in the form of beads or extrudates. A conventional granular hydrotreatment catalyst comprising at least one metal or metal compound with a hydrodehydrogenating function on an amorphous support can be used. This catalyst can be a catalyst comprising group VIII metals, for example nickel and/or cobalt, usually in combination with at least one group VIb metal, for example molybdenum and/or tungsten. As an example, it is possible to use a catalyst comprising 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) on an amorphous mineral support. The total amount of group VI and VIII metal oxides is usually about 5% to about 40% by weight, generally about 7% to 30% by weight and the weight ratio, expressed as the metal oxide, between the group VI metal (or metals) and the group VIII metal (or metals) is generally about 20 to about 1, usually about 10 to about 2.

In the distillation zone of step d), the conditions are generally selected such that the cut point for the heavy feed is about 350° C. to about 400° C., preferably about 360° C. to about 380° C., for example about 370° C. In this distillation zone, a gasoline fraction is also recovered with an end point which is usually about 150° C., and a gas oil fraction with an initial boiling point which is normally about 150° C. and an end point which is about 370° C.

Finally, in a variation mentioned above, in catalytic cracking step e) at least a portion of the heavy fraction of the hydrotreated feed obtained in step d) can be sent to a catalytic cracking section in which it is catalytically cracked in a conventional manner under conditions which are well known to the skilled person, to produce a fuel fraction (comprising a gasoline fraction and a gas oil fraction) at least a portion of which is normally sent to fuel storage zones and into a slurry fraction at least a portion or all of which, for example, is sent to the heavy fuel pool or at a portion or all of which is recycled to catalytic cracking step e). In the present invention, the expression "catalytic cracking" encompasses all cracking processes which treat a heavy fraction with a high Conradson Carbon, for example those using temperature control techniques such as MTC techniques, or the catalyst temperature control technique such as those known in the art as a catalyst cooler. In a particular implementation of the invention, a portion of the gas oil fraction (either LCO, or HCO, or DO, or slurry) obtained during step e) is recycled either to step a), or to step c), or to step e) mixed with the feed introduced into this catalytic cracking step e). In the present description, the term "a portion of the gas oil fraction" is understood to means a fraction less than 100%. The scope of the present invention also encompasses recycling a portion of the gas oil fraction (LCO, HCO, slurry, DO) to step a), a portion to step c) and a further portion to step e), the ensemble of these portions clearly not representing the whole of the gas oil fraction. It is also possible, in the present invention, to recycle all of the gas oil fraction (LCO, HCO, DO, slurry) obtained by catalytic cracking either to step a), or to step c), or to step e), or a fraction to each of these steps, the sum of these fractions representing up to 100% of the gas oil fraction obtained in step e). It is also possible to recycle at least a portion of the gasoline fraction obtained in this catalytic cracking step e) to step e).

Catalytic cracking step e) is usually a fluidised bed catalytic cracking step, for example using the R2R process developed by the Applicant. This step can be carried out conventionally in a known manner under suitable cracking conditions to produce lower molecular weight hydrocarbon products. This step can use heat exchange apparatus and processes, in particular for solid particles, to reduce the temperature of the catalyst at the inlet to the reaction zone. Descriptions of the operation and catalysts suitable for fluidised bed cracking in step e) have been described, for example, in patents U.S. Pat. No. 4,695,370, EP-B-0-184 517, U.S. Pat. No. 4,959,334, EP-B-0 323 297, U.S. Pat. Nos. 4,965,232, 5,120,691, 5,344,554, 5,449,496, EP-A-0 485 259, U.S. Pat. Nos. 5,286,690, 5,324,696, EP-B-0 542 604 and EP-A-0 699 224, the descriptions of which are hereby deemed to be incorporated in the present description by reference.

The fluidised bed catalytic cracking reactor can operate in upflow or downflow mode. While this is not a preferred embodiment of the present invention, it is also possible to carry out the catalytic cracking in a moving bed reactor. Particularly preferred catalytic cracking catalysts are those which contain at least one zeolite which is normally mixed with a suitable matrix such as alumina, silica or silica-alumina.

BRIEF DESCRIPTION OF THE DRAWINGS

FIGS. 1, 2, 3, 4 and 5 are diagrammatic representations of the process of the present invention. In the figures, similar means are designated by the same reference letters and numerals. In FIG. 1, the hydrocarbon feed to be treated enters via lines 10 and 15 into a section (1) for treatment in the presence of hydrogen, said hydrogen being introduced into said section via lines 19 and 15. Catalyst is added via line 16 and withdrawn via line 17. The effluent treated in zone (1) is sent via line 18 to a fines separation zone (S) from which an effluent which is depleted in fines is recovered which is sent via line **18*f* to a section (2) for hydrotreatment in the presence of hydrogen introduced via lines 19*a* and 18*f* and optionally in the presence of a hydrocarbon cut, introduced via line 20*a*, such as a heavy fraction from a fluidised bed catalytic cracking unit (LCO, HCO, DO, slurry) or a heavy fraction from straight run distillation, and the hydrotreated effluent is recovered via line 20**.

Figure 1:
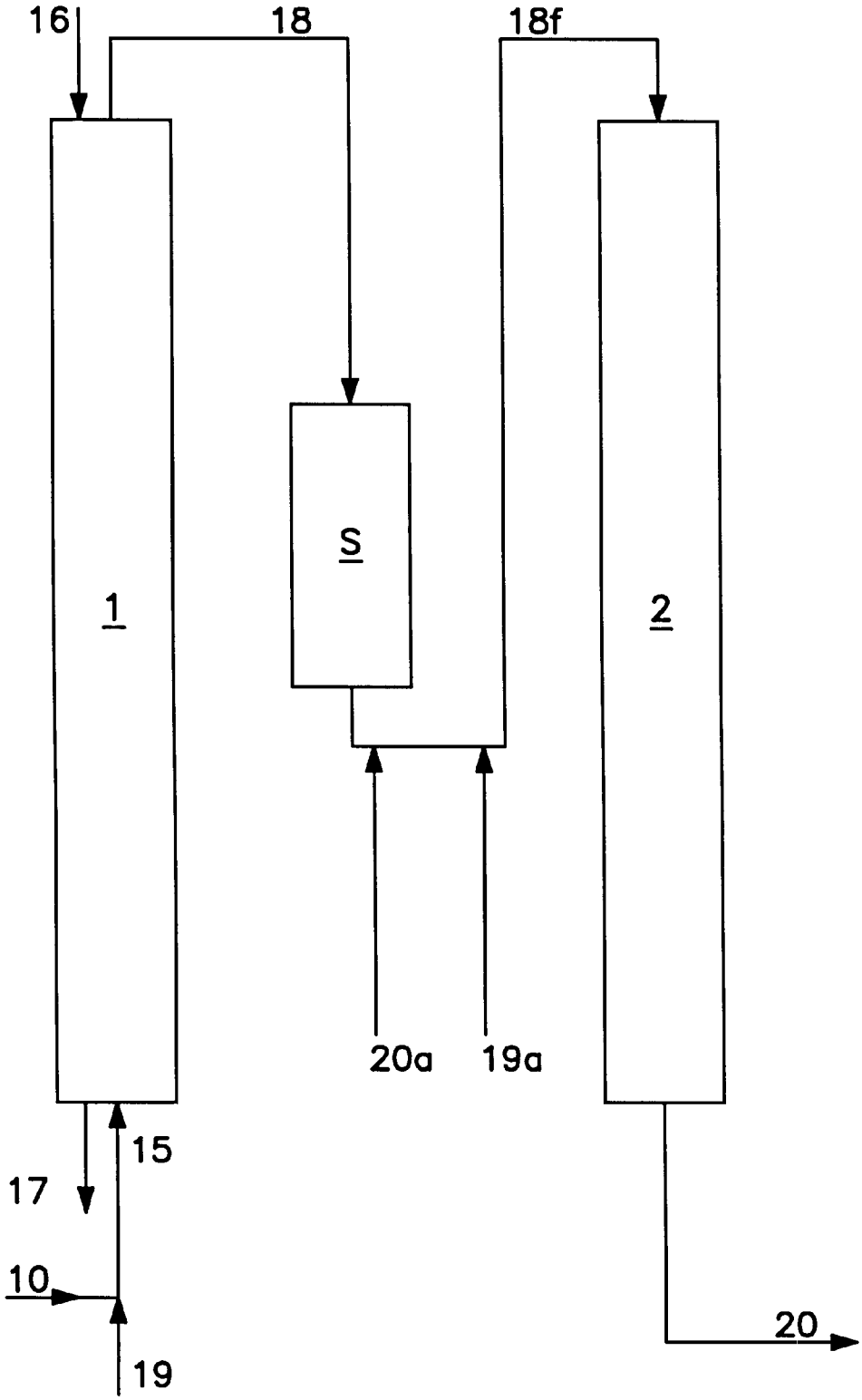
FIG. 1 depicts one exemplary embodiment of the present invention.
Figure 2:
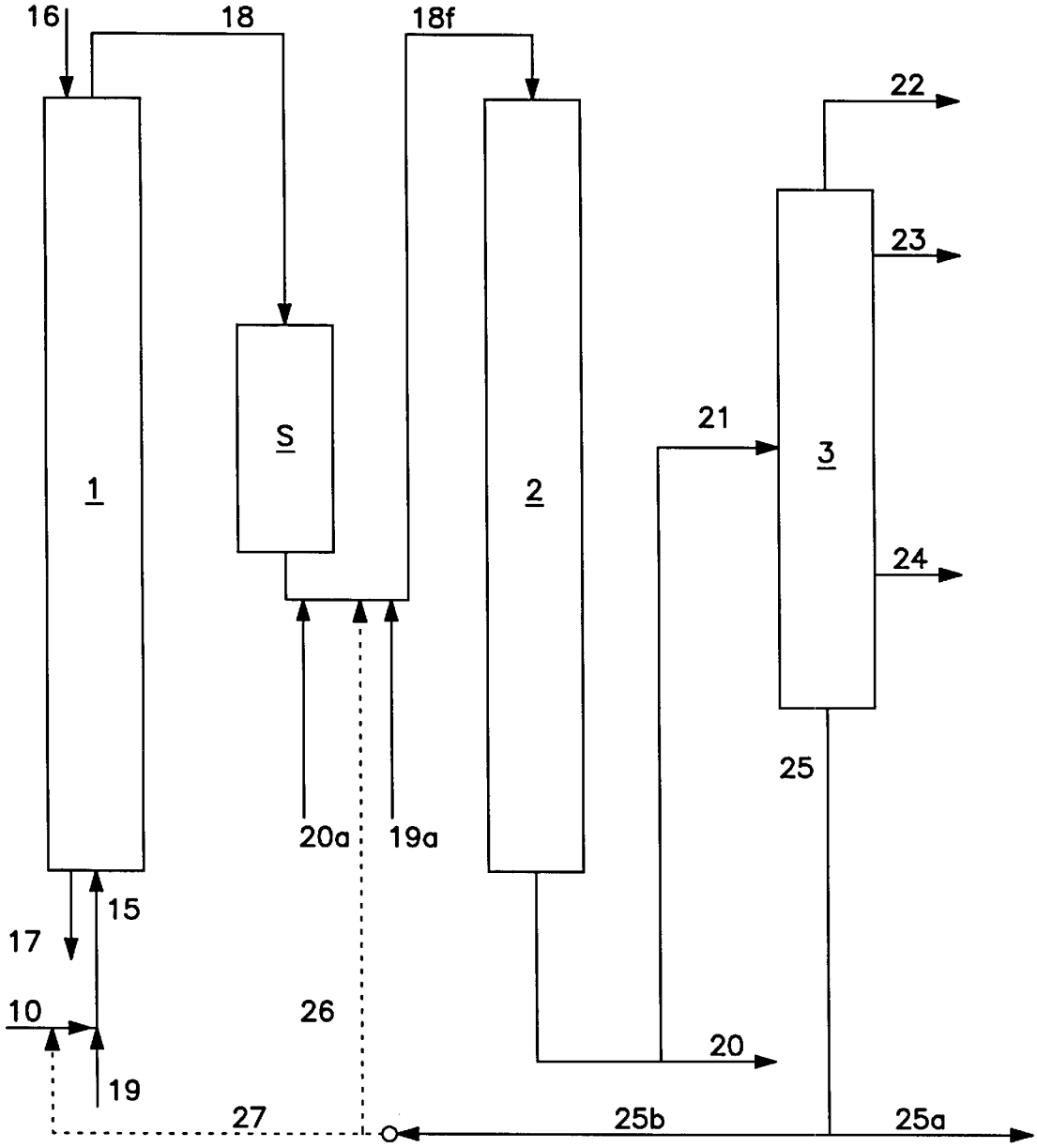
FIG. 2 depicts another exemplary embodiment of the present invention.

In a particular implementation, the invention shown diagrammatically in FIG. 2, a portion of the hydrotreated effluent is recovered via line 20 and a further portion is sent via line 21 to a distillation zone from which a gas fraction is recovered via line 22, a gasoline fraction is recovered via line 23, a gas oil fraction is recovered via line 24 and a liquid fraction which is heavier than the gas oil fraction is recovered via line 25. At least a portion of this liquid fraction which is heavier than the gas oil fraction can optionally be sent to the hydrotreatment section (2) via line 26 and optionally at least a portion can be sent to treatment section (1) via line 27.

Figure 3:
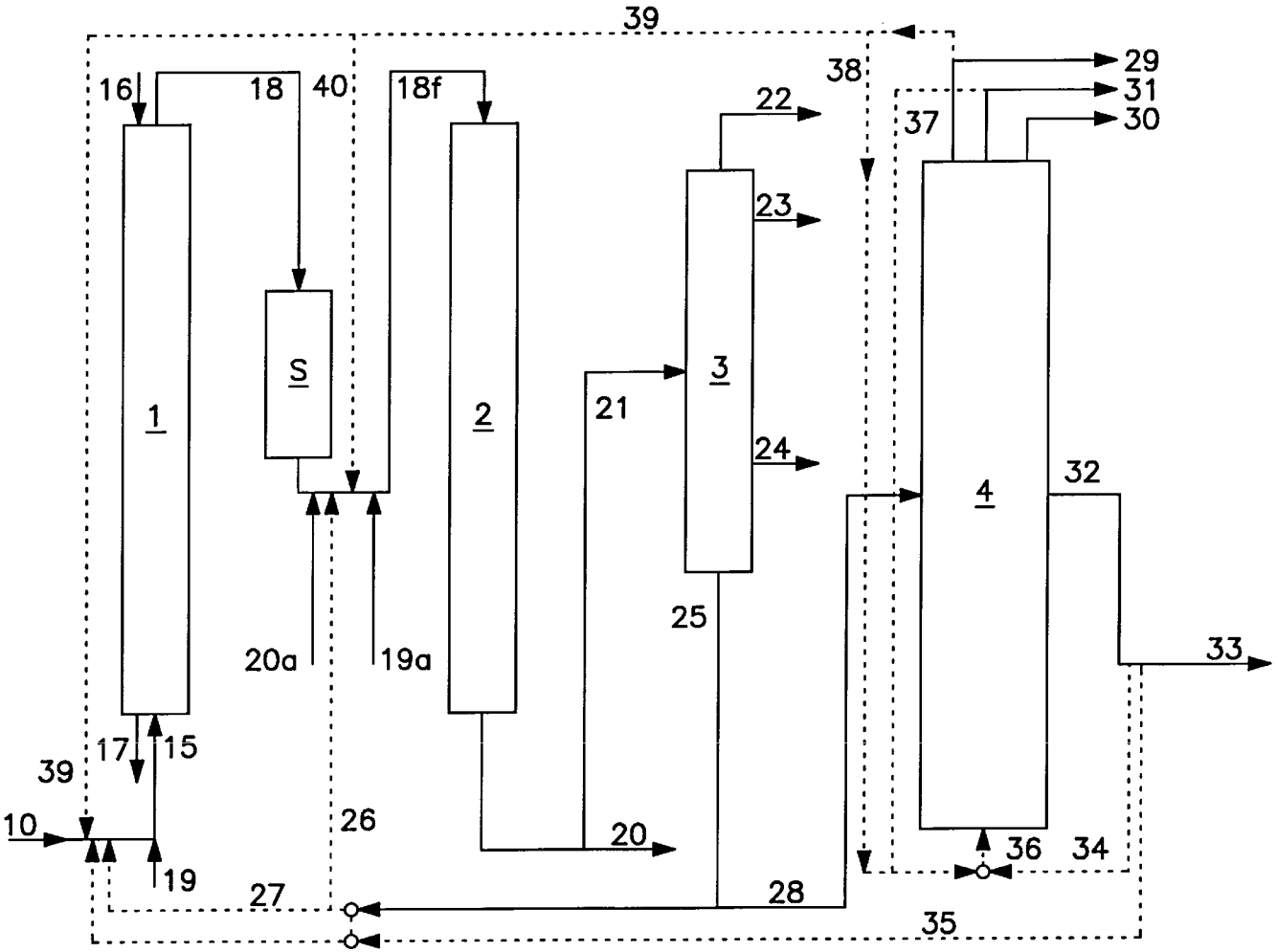
FIG. 3 depicts yet another exemplary embodiment of the present invention.

In a particular embodiment of the invention shown in FIG. 3, a portion of the liquid fraction which is heavier than the gas oil fraction recovered via line 25 is sent via line 28 to a catalytic cracking section (4) from which a gas fraction is recovered via line 30, a gasoline fraction is recovered via line 31, a gas oil fraction is recovered via line 29 and a heavier fraction, known in the art as slurry, is recovered via line 32, part of which is sent via line 33 to the heavy fuel pool, a further portion of this slurry fraction is optionally sent via line 34 then line 36 to the catalytic cracking section (4), a further portion of this slurry fraction is optionally sent via line 35, then via line 26 to hydrotreatment section (2). A portion of the gasoline fraction is optionally sent to the catalytic cracking zone (4) via line 37 and line 36. A portion of the gas oil fraction is optionally sent via line 38 then via line 36 to the catalytic cracking zone (4), a further portion of this same fraction is optionally sent to treatment section (1) via line 39; a further portion of this same fraction is optionally sent to hydrotreatment section (2) via line 40.

Figure 4:
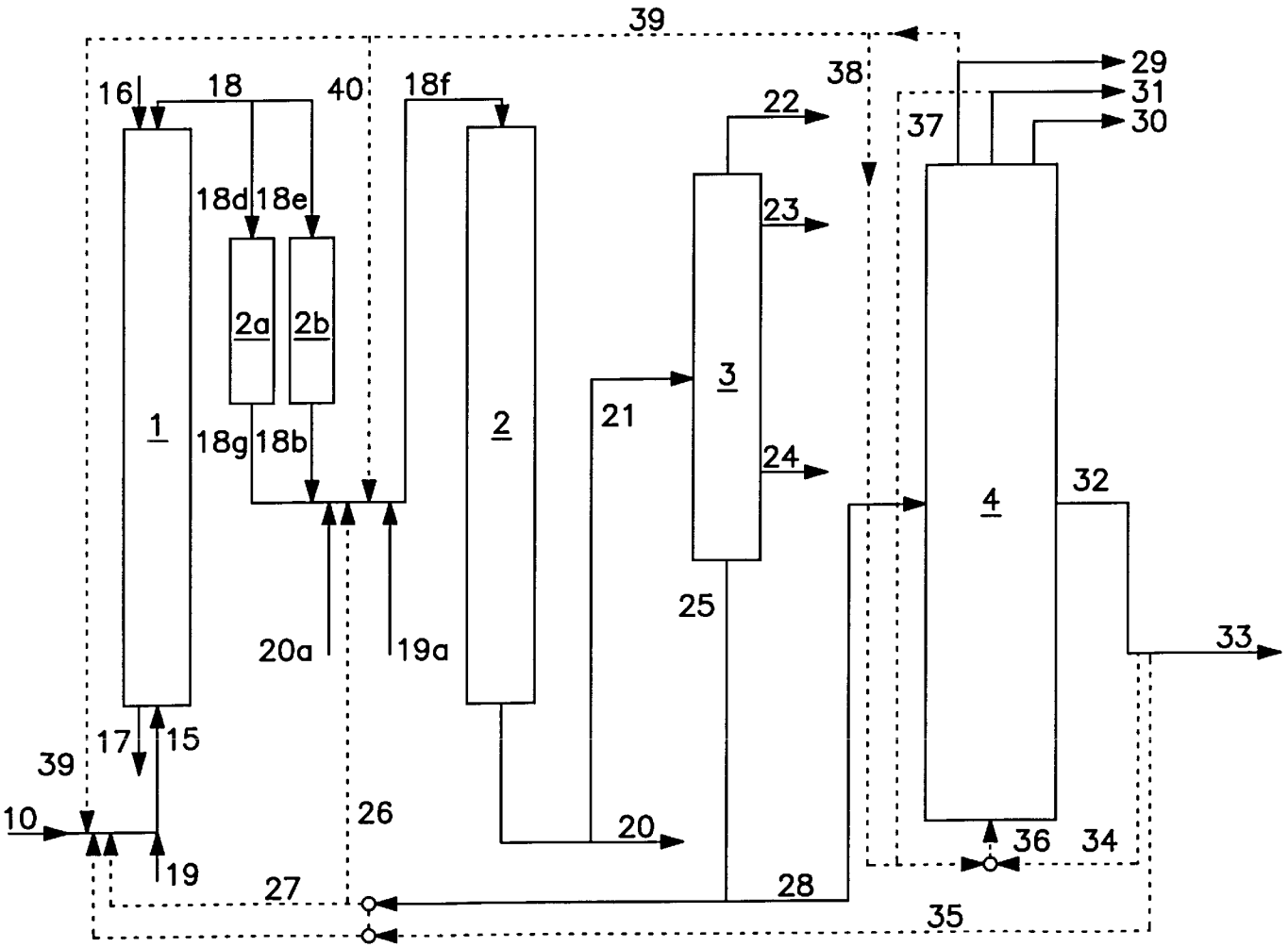
FIG. 4 depicts a further exemplary embodiment of the present invention.

In a particular implementation of the invention, shown in FIG. 4, the effluent recovered via line 18 after treatment in section (1) is sent, via lines **18*d* and 18*e*, to a fines separation zone composed of two means 2*a* and 2*b* normally functioning in alternation to recover an effluent which is depleted in fines via lines 18*g* and 18*h* and sent via line 18*f* to section (2) for hydrotreatment in the presence of hydrogen introduced via lines 19***a* and 18*f*. When means 2a recovers fines, means 2*b* is regenerated, and while means 2*b* recovers fines, means 2*a* regenerated. These means are, for example, composed of one or more particle filters. These filters are normally calibrated filters.

Figure 5:
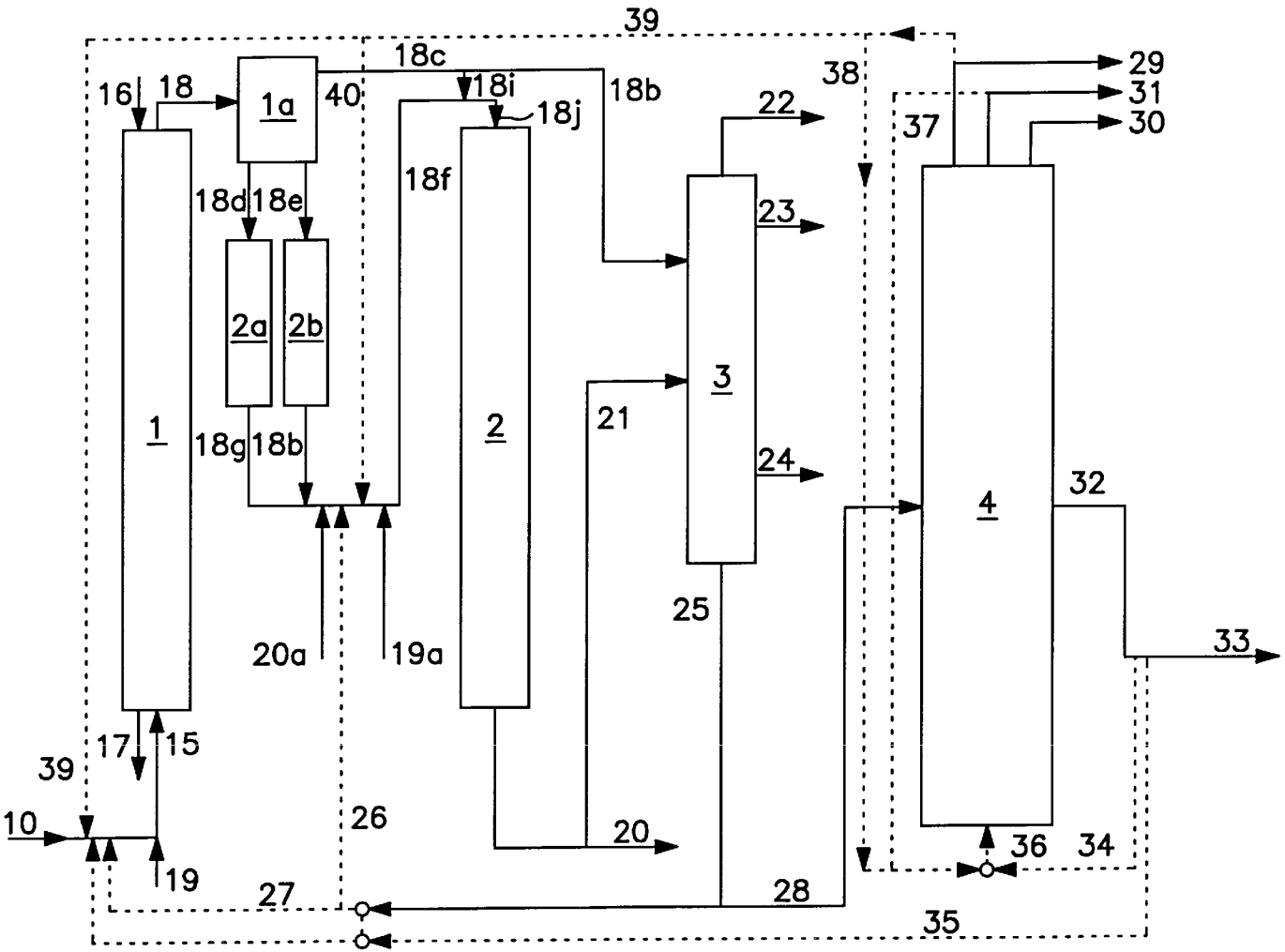
FIG. 5 depicts a still further exemplary embodiment of the present invention.

In a particular implementation of the invention, shown in FIG. 5, the effluent recovered via line 18 after treatment in section (1) is sent to a zone (1*a*) in which said effluent is split into a heavy liquid fraction which is sent via lines 18*d* and 18*e* to means 2*a* and 2*b* for fines separation from which an effluent which is depleted in fines is recovered and sent to section (2) via line 18*f* for hydrotreatment in the presence of hydrogen introduced via lines 19*a* and 18*f*, and into a light fraction which is recovered via line 18*c*, a portion of this light fraction optionally being sent to distillation zone (3) via line 18*b*, a further portion of said fraction 18*c* can be sent via lines 18*i* and 18*j* to hydrotreatment section (2).

EXAMPLES

These examples are the results of experiments carried out in pilot units.

Example 1 (Comparative)

A Safaniya heavy vacuum residue (RSV(Sa)) was treated. Its characteristics are shown in column 1 of Table 1a. The yields were calculated using RSV(Sa) as the basis (100%).

This Safaniya vacuum residue was treated in a pilot unit comprising two ebullated catalyst bed reactors in series. The total volume in each reactor was 3 liters.

This pilot unit simulated an industrial H-Oil ebullated bed vacuum residue hydrotreatment unit. It has been shown elsewhere that this pilot unit produces results which are equivalent to those of industrial units. The fluids were in upflow mode in the reactor, as is the case in industrial units. It has been shown elsewhere that this mode of pilot unit operation provides results which are equivalent to those of industrial units.

The reactors were each charged with 2 liters of an industrial catalyst specific for H-Oil industrial units.

The operating conditions were as follows:

global HSV with respect to reactor volume: 0.3 $h^{-1}$;

pressure: 150 bar (15 MPa);

hydrogen recycle: 600 liters of hydrogen per liter of feed, temperatures in the reactors: 425° C.

The liquid products from the second reactor were fractionated in the laboratory into a gasoline fraction (IP-150° C.), a gas oil fraction (150–370° C.), a hydrotreated vacuum distillate (DSV(T1), 370–550° C.) and a residual hydrotreated fraction (RSV(T1), 550° $C.^{+}$).

Column 5 of Table 1a shows the yields and principal characteristics of the DSV(T1) produced and column 4 shows those for RSV(T1). Column 3 indicates the characteristics of the hydrotreated atmospheric residue (RA(T1)), i.e., the mixture of RSV(T1) and DSV(T1). Note the high degree of conversion which is indicated by a low unconverted RSV(Sa) yield.

Column 1 of Table 2a shows the yields and principal characteristics of the gasoline produced and column 1 of Table 3a shows the yields and principal characteristics of the gas oil produced. The hydrotreated RA(T1) has relatively low characteristics in terms of Conradson Carbon. The amount of Conradson Carbon (16%) is too high to allow secondary cracking in a conventional catalytic residue cracking unit. As a result, it was not possible to produce complementary quantities of gasoline and gas oil. Further, this RA(T1) had an insolubles content in accordance with standard IP375 of 0.9% by weight, which was high for upgrading this pure product as a heavy fuel oil. This product could, however, advantageously be fluxed with an aromatic diluent (LCO and HCO) which will reduce the insolubles content to less than 0.1% by weight and thus enable it to be upgraded as a heavy fuel oil.

TABLE 1a

| Cut | RSV(Sa) Safaniya | C5+ ex-H-oil | RA(T1) ex-H-oil | RSV(T1) ex-H-oil | DSV(T1) ex-H-oil |
|---|---|---|---|---|---|
| Yield/RSV(Sa) % by weight | 100.0 | 91.8 | 51.0 | 22.3 | 28.7 |
| Density, 15/4 | 1.046 | 0.906 | 0.994 | 1.065 | 0.945 |
| Sulphur % by weight | 5.39 | 1.0 | 1.6 | 2.55 | 0.95 |
| Conradson Carbon | 24 | 9 | 16 | 37 | 0.5 |
| C7 asphaltenes % by weight | 14.5 | 6 | 10 | 23.9 | 0.02 |
| Ni + V ppm | 213 | 23 | 41 | 93 | <1 |
| IP375 insoluble (% by weight) | | | 0.9 | | |

TABLE 2a

| | Gasoline Ex-H-oil |
|---|---|
| Yield/RSV(Sa) % by weight | 9.5 |
| Density 15/4 | 0.705 |
| Sulphur, % by weight | 0.03 |
| Octane (RON + MON)/2 | 56 |

TABLE 3a

| | Gasoline Ex-H-oil |
|---|---|
| Yield/RSV(Sa) % by weight | 31.3 |
| Density 15/4 | 0.857 |
| Sulphur, % by weight | 0.2 |
| Cetane | 42 |

Example 2 (Comparative)

A heavy Safaniya vacuum residue (RSV(Sa)) was treated. Its characteristics are shown in column 1 of Table 1b. The yields were calculated using RSV(Sa) as the basis (100%).

The Safaniya vacuum residue was treated in a pilot unit comprising three fixed catalyst bed reactors in series.

This pilot unit simulated an industrial HYVAHL fixed bed vacuum residue hydrotreatment unit. The fluids were in downflow mode in these reactors, as is the case in industrial units. It has been shown elsewhere that this mode of pilot unit operation provides results which are equivalent to those of industrial units.

The catalytic volume of each reactor was 7 liters and it contained 7 liters of catalyst. The first reactor was charged with a commercial catalyst sold by PROCATALYSE with reference number HMC841 and the other two reactors were charged with a commercial catalyst sold by PROCATALYSE under reference number HT308.

The operating conditions were as follows:

global HSV: 0.14 $h^{-1}$;

pressure: 150 bar (15 MPa);

hydrogen recycle: 1300 liters of hydrogen per liter of feed;

temperatures in the reactors: 390–385–380° C.

The liquid products from the reactors were fractionated in the laboratory into a gasoline fraction (IP-150° C.), a gas oil fraction (150–370° C.), a vacuum distillate fraction (DSV (T2), 370–550° C.) and a residual fraction (RSV(T2), 550° $C.^{+}$).

Column 5 of Table 1b shows the yields and the principal characteristics of DSV (T2) produced and column 4 shows those of RSV(T2). Column 3 indicates the characteristics of the hydrotreated atmospheric residue (RA(T2)), i.e., the mixture of RSV(T2) and DSV(T2).

Column 1 of Table 2b shows the yields and principal characteristics of the gasoline produced and column 1 of Table 3b shows the yields and principal characteristics of the gas oil produced.

It can be seen that, compared with the preceding case described in Example 1, the degree of conversion was lower, as indicated by a higher yield of unconverted RSV(Sa). In contrast, the RA(T2) and RSV(T2) products were of better quality. Because of its good characteristics (Conradson Carbon, metals), the hydrotreated RA(T2) was sent to an R2R type residue catalytic cracking pilot unit comprising means for controlling the catalyst temperature.

This pilot unit simulated an industrial R2R type circulating fluidised catalyst bed catalytic residue cracking unit. It has been shown that this pilot unit provides results equivalent to those of R2R industrial units.

Column 3 of Table 1b shows the characteristics of fraction (RA(T2) which formed the feed which was sent to the R2R type catalytic cracking pilot unit (two regenerators) using a catalyst containing 20% by weight of Y zeolite and 80% by weight of a silica-alumina matrix. This feed, preheated to 190° C., was brought into contact with a hot regenerated catalyst from a pilot regenerator, at the bottom of a vertical pilot reactor. The temperature of the catalyst at the reactor inlet was 780° C. The ratio of the flow rate of the catalyst to the flow rate of the feed was 6.1. the heat added by the catalyst at 780° C. enabled the feed to vaporise and the cracking reaction which is endothermic, to occur. The average residence time for the catalyst in the reaction zone was about 2 seconds. The operating pressure was 1.8 bars absolute. The temperature of the catalyst, measured at the riser fluidised bed reactor outlet, was 517° C. The cracked hydrocarbons and the catalyst were separated with cyclones located in a disengagement zone (stripper) where the catalyst was stripped. The catalyst which had been coked during the reaction and stripped in the disengagement zone was then sent to the first regenerator. The amount of coke in the solid (delta coke) at the inlet to the first regenerator was 1.35%. This coke was burned in two steps with air injected into each regenerator. The highly exothermic combustion raised the temperature of the solid from 517° C. to 780° C. The hot regenerated catalyst left the second regenerator and was returned to the bottom of the reactor.

The hydrocarbons separated from the catalyst left the disengagement zone, they were cooled by exchangers and sent to a stabilisation column which separated the gases from the liquids. The liquid (C5+) was also sampled then fractionated in a further column to recover a gasoline fraction, a gas oil fraction and a heavy fuel or slurry from a (370° C.+). Column 2 of Table 2b (gasoline) and column 2 of Table 3b (gas oil) show the results and the principal characteristics of the products obtained.

The gas fraction recovered by distillation of the effluent leaving the hydrotreatment and the gas fraction recovered from the product from the catalytic cracking were mixed and the same was carried out with the two gas oil fractions. Column 3 of Table 2b (gasoline) and column 3 of Table 3b (gas oil) show the total results for gasoline and gas oil obtained and the principal characteristics of these products.

High yields of gasoline were obtained but only medium yields of gas oil with medium sulphur contents.

Further, the characteristics of the hydrotreated RA(T2) were good in terms of the insolubles content in accordance with standard IP375 (,0.1% by weight), which rendered upgrading as a heavy fuel oil possible without complementary fluxing, in contrast to the case of the preceding example where complementary fluxing was unavoidable.

TABLE 1b

| Cut | RSV(Sa) Safaniya | C5+ ex-Hyvahl | RA(T2) ex-Hyvahl | RSV(T2) ex-Hyvahl | DSV(T2) ex-Hyvahl |
|---|---|---|---|---|---|
| Yield/RSV(Sa) % by weight | 100.0 | 93.7 | 69.7 | 42.6 | 27.1 |
| Density, 15/4 | 1.046 | 0.932 | 0.971 | 0.994 | 0.937 |
| Sulphur % by weight | 5.39 | 0.5 | 0.7 | 0.9 | 0.29 |
| Conradson Carbon | 24 | 6 | 8 | 13 | 0.1 |
| C7 asphaltenes % by weight | 14.5 | 2 | 3 | 4.1 | 0.01 |
| Ni + V ppm | 213 | 7 | 9 | 15 | |
| IP375 insoluble (% by weight) | | | <0.1 | | |

TABLE 2b

| | Gasoline Ex-Hyvahl | Gasoline Ex R2R | Total gasoline |
|---|---|---|---|
| Yield/RSV(Sa) % by weight | 5.2 | 30.0 | 35.2 |
| Density 15/4 | 0.737 | 0.746 | 0.745 |
| Sulphur, % by weight | 0.0006 | 0.017 | 0.014 |
| Octane (RON + MON)/2 | 54 | 87 | 82 |

TABLE 3b

| | Gasoline Ex-Hyvahl | Gasoline Ex R2R | Total gasoline |
|---|---|---|---|
| Yield/RSV(Sa) % by weight | 18.8 | 10.5 | 29.3 |
| Density 15/4 | 0.865 | 0.948 | 0.893 |
| Sulphur, % by weight | 0.02 | 0.99 | 0.37 |
| Cetane | 41 | 21 | 34 |

Example 3 (In Accordance With the Invention)

A heavy Safaniya vacuum residue (RSV(Sa)) was treated. Its characteristics are shown in column 1 of Table 1c. The yields were calculated using RSV(Sa) as the basis (100%).

This Safaniya vacuum residue was treated in a pilot unit comprising three reactors in series: the first reactor was an ebullated bed reactor while the last two reactors were fixed catalyst bed reactors. The fluids were in upflow-mode in the first reactor, while those in the second and third reactors were in downflow mode. Between the outlet from the ebullated bed reactor and the inlet to the first fixed bed reactor, a 25 micron porosity filter was positioned to trap the catalyst fines produced in the ebullated bed reactor.

The catalytic volume of each reactor was 3 liters. The first, ebullated bed, reactor was charged with 1.5 l of an industrial catalyst specific for commercial H-Oil units. Reactors 2 and 3 were each charged with 3 l of a commercial catalyst sold by PROCATALYSE under reference number HT308.

The operating conditions in reactor n°l were as follows:

HSV with respect to reactor: 0.5 $h^{-1}$;

pressure: 150 bar (15 MPa), hydrogen recycle: 400 liters of hydrogen per liter of feed, temperature in the reactors: 430° C.

The operating conditions in reactors 2 and 3 were as follows:

HSV with respect to 2 reactors: 0.25 $h^{-1}$;

pressure. 150 bar (15 MPa);

hydrogen recycle: 1000 liters of hydrogen per liter of feed;

temperatures in the reactors: 380° C.

The liquid products from the reactors were fractionated in the laboratory into a gasoline fraction (IP-150° C.), a gas oil fraction (150–370° C.), a vacuum distillate fraction (DSV (T3), 370–550° C.) and a residual fraction (RSV(T3), 550° $C.^{+}$).

Column 5 of Table 1c shows the yields and the principal characteristics of DSV (T3) produced and column 4 shows those of RSV(T3). Column 3 indicates the characteristics of the hydrotreated atmospheric residue (RA(T3)), i.e., the mixture of RSV(T3) and DSV(T3).

Column 1 of Table 2c shows the yields and principal characteristics of the gasoline produced and column 1 of Table 3c shows the yields and principal characteristics of the gas oil produced.

It can be seen that the degree of conversion was higher than in Example 2 (fixed bed) and close to that of Example 1 (ebullated bed), as indicated by a low yield of unconverted RSV(Sa).

Further the RA(T3) and RSV(T3) produced were of better quality than in Example I and close to the qualities obtained in Example 2.

Because of its characteristics (Conradson Carbon, metals), the hydrotreated RA(T3) was sent to an R2R type residue catalytic cracking pilot unit comprising means for controlling the catalyst temperature.

This pilot unit simulated an industrial R2R type circulating fluidised catalyst bed catalytic residue cracking unit. It has been shown that this pilot unit provides results equivalent to those of R2R industrial units.

Column 3 of Table 1c shows the characteristics of fraction (RA(T3) which form the feed which is sent to the R2R type catalytic cracking pilot unit (two regenerators) using a catalyst containing 20% by weight of Y zeolite and 80% by weight of a silica-alumina matrix. This feed, preheated to 180° C., was brought into contact, at the bottom of a vertical pilot reactor, with a hot regenerated catalyst from a pilot regenerator. The temperature of the catalyst at the reactor inlet was 780° C. The ratio of the flow rate of the catalyst to the flow rate of the feed was 7. The heat added by the catalyst at 780° C. enabled the feed to vaporise and the cracking reaction, which is endothermic, to occur. The average residence time for the catalyst in the reaction zone was about 2 seconds. The operating pressure was 1.8 bars absolute. The temperature of the catalyst, measured at the riser fluidised bed reactor outlet, was 520° C. The cracked hydrocarbons and the catalyst were separated with cyclones located in a disengagement zone (stripper) where the catalyst was stripped. The catalyst which had been coked during the reaction and stripped in the disengagement zone was then sent to the first regenerator. The amount of coke in the solid (delta coke) at the inlet to the first regenerator was 1.35%. This coke was burned in two steps by air injected into each regenerator. The highly exothermic combustion raised the temperature of the solid from 520° C. to 780° C. The hot regenerated catalyst left the second regenerator and was returned to the bottom of the reactor.

The hydrocarbons separated from the catalyst left the disengagement zone; they were cooled by exchangers and sent to a stabilisation column which separated the gases from the liquids. The liquid (C5+) was also sampled then fractionated in a further column to recover a gasoline fraction, a gas oil fraction and a heavy fuel or slurry (370° C.+). Column 2 of Table 2c (gasoline) and column 2 of Table 3c (gas oil) show the results and principal characteristics of the products obtained.

The gas fraction recovered by distillation of the effluent leaving the hydrotreatment and the gas fraction recovered from the product from catalytic cracking were then mixed and the same was carried out with the two gas oil fractions. Column 3 of Table 2c (gasoline) and column 3 of Table 3c (gas oil) show the total results for gasoline and gas oil obtained and the principal characteristics of these products.

In contrast to the two preceding cases, high yields of both gasoline and gas oil were obtained, with comparable product qualities.

Further, the characteristics of the hydrotreated RA(T3) were good in terms of the insolubles content in accordance with standard IP375 (0.15% by weight), which rendered upgrading as a heavy fuel oil possible without complementary fluxing.

It can thus be seen that the combination of ebullated beds and fixed beds in series can combine the advantages of the two technologies, i.e., high yields of both gasoline and gas oil, while producing a stable residue which can be a good feed for catalytic cracking or a base for a heavy fuel without complementary fluxing.

TABLE 1c

| Cut | RSV (Sa) Safan-iya | C5+ ex-H-oil + HYVAHL | RA(T3) ex-H-oil + HYVAHL | RSV(T3) ex-H-oil + HYVAHL | DSV(T3) ex-H-oil + HYVAHL |
|---|---|---|---|---|---|
| Yield/RSV(Sa) % by weight | 100.0 | 91.8 | 54.0 | 27.3 | 26.7 |
| Density, 15/4 | 1.046 | 0.901 | 0.965 | 0.994 | 0.937 |
| Sulphur % by weight | 5.39 | 0.5 | 0.9 | 1.2 | 0.5 |
| Conradson Carbon | 24 | 6 | 9 | 18.6 | 0.1 |
| C7 asphaltenes % by weight | 14.5 | 2 | 3 | 6 | 0.01 |
| Ni + V ppm | 213 | 9 | 15 | 30 | <1 |
| IP375 insoluble (% by weight) | | | 0.15 | | |

TABLE 2c

| | Gasoline Ex-Hoil + HYVAl | Gasoline Ex R2R | Total gasoline |
|---|---|---|---|
| Yield/RSV(Sa) % by weight | 8.5 | 23.2 | 31.7 |

TABLE 2c-continued

| | Gasoline Ex-Hoil + HYVAl | Gasoline Ex R2R | Total gasoline |
|---|---|---|---|
| Density 15/4 | 0.720 | 0.746 | 0.739 |
| Sulphur, % by weight | 0.01 | 0.021 | 0.018 |
| Octane (RON + MON)/2 | 55 | 86 | 78 |

TABLE 3c

| | Gasoline Ex-Hoil + HYVA | Gasoline Ex R2R | Total gasoline |
|---|---|---|---|
| Yield/RSV(Sa) % by weight | 29.3 | 8.1 | 37.4 |
| Density 15/4 | 0.860 | 0.948 | 0.878 |
| Sulphur, % by weight | 0.03 | 1.28 | 0.30 |
| Cetane | 42 | 20 | 37 |

What is claimed is:

1. A process for converting a hydrocarbon feed containing at least one hydrocarbon fraction with a sulphur content of at least 0.1% by weight, an initial boiling point of at least 340° C. and an end point of at least 440° C., characterized in that it comprises the following steps:

a) treating said hydrocarbon feed in a section for treatment carried out in the presence of hydrogen, said section comprising at least one three-phrase reactor, containing at least one hydroconversion catalyst wherein a mineral support is at least partially amorphous, in an ebullated bed, operating in liquid and gas upflow mode, said reactor comprising at least one means for withdrawing catalyst from said reactor located close to the reactor bottom and at least one means for supplying fresh catalyst to said reactor located close to the top of said reactor;

b) sending at least one portion of the effluent from step a) to a section for eliminating catalyst particles containing in said effluent, said section comprising at least one means for eliminating said solid particles and at least one means for recovering an effluent containing fewer solid particles than the effluent from step a);

c) sending at least a portion of the effluent from step b) to a section for treatment carried out in the presence of hydrogen, said section comprising at least one reactor containing at least one fixed bed hydrotreatment catalyst wherein the mineral support is at least partially amorphous, under conditions enabling an effluent with a reduced sulphur content and a high middle distillate content to be obtained.

2. A process according to claim 1, in which the hydrocarbon feed is an atmospheric residue, a straight run vacuum residue, a vacuum residue from the conversion process, an oil deasphalted using a solvent, of propane, butane or pentane, an asphalt diluted by a hydrocarbon fraction of an LCO, an HCO, a DO, a VGO a slurry, or combinations thereof, the gas oil and vacuum gas oil obtained by straight run distillation and the various hydrocarbon fractions produced being capable of being recycled in mixtures in any proportions with the feeds cited above.

3. A process according to claim 1, in which a hydrocarbon fraction is added to the effluent from step b).

4. A process according to claim 1, in which at least a portion of the effluent obtained from step c) is sent to a distillation zone (step d) from which a gas fraction, a gasoline engine fuel fraction, a gas oil engine fuel fraction and a liquid fraction which is heavier than the gas oil fraction are recovered.

5. A process according to claim 4, in which the liquid fraction which is heavier than the gas oil fraction obtained from step d) is sent to a catalytic cracking section (step e) in which it is treated under conditions which produce a gas fraction, a gasoline fraction, a gas oil fraction and a slurry fraction.

6. A process according to claim 5, in which at least a portion of the gas oil fraction recovered in catalytic cracking step e) is recycled to step a) and/or step c).

7. A process according to claim 5, in which catalytic cracking step e) is carried out under conditions which produce a gasoline fraction at least a portion of which is sent to a fuel storage zone, a gas oil fraction at least a portion of which is sent to a gas oil storage zone and a slurry fraction at least a portion of which is sent to a heavy fuel storage zone.

8. A process according to claim 7, in which at least a portion of the gas oil fraction and/or the gasoline fraction obtained in catalytic cracking step e) is recycled to the inlet of the catalytic cracking section.

9. A process according to claim 5, in which at least a portion of the slurry fraction obtained in catalytic cracking step e) is recycled to the inlet of the catalytic cracking step.

10. A process according to claim 4, in which at least a portion of the liquid fraction which is heavier than the gas oil fraction obtained in step d) or f) is returned either to the hydroconversion of step a), or to the hydrotreatment step of c), or to each of these two sections.

11. A process according to claim 1, characterized in that it comprises a step a1) between step a) and step b) in which the product from step a) is split into a heavy liquid fraction which is sent to step b) for eliminating solid catalyst particles and into a lighter fraction which is recovered.

12. A process according to claim 11, in which the lighter liquid fraction which is recovered is sent to a distillation zone from which a gas fraction, a gasoline engine fuel, a gas oil engine fuel and a liquid fraction which is heavier than the gas oil fraction are recovered.

13. A process according to claim 11, in which the lighter liquid fraction which is recovered is sent to the distillation zone of step d).

14. A process according to claim 1, in which the step b comprises using at least two separation means in parallel one of which is used to carry out separation while the other is purged of retained fines.

15. A process according to claim 1, in which during step a) the treatment in the presence of hydrogen is carried out under an absolute pressure of 2.5 to 35 MPa, at a temperature of about 330° C. to 550° C. with an hourly space velocity of about 0.1 to 10 $h^{-1}$ and the quantity of hydrogen mixed with the feed is about 50 to 5000 $Nm^3/m^3$.

16. A process according to claim 1, in which hydrotreatment step c) is carried out at an absolute pressure of about 2 to 35 MPa, at a temperature of about 300° C. to 500° C. with an hourly space velocity of about 0.1 to 5 $h^{-1}$ and the quantity of hydrogen mixed with the feed is about 100 to 5000 $Nm^3/m^3$.

17. A process according to claim 4, in which at least a portion of the heavier liquid fraction of hydrotreated feed obtained in step d) is sent to a heavy fuel storage zone.

18. A process according to claim 4, in which at least a portion of the gasoline engine fuel fraction and the gas oil engine fuel fraction obtained from step d) are sent to respective fuel storage zones.

19. A process according to claim 2, in which a hydrocarbon fraction is added to the effluent from step b).

20. A process according to claim 5, in which at least a portion of the gas oil fraction recovered in catalytic cracking step e) is recycled to step a) and step c).

21. A process according to claim 1, wherein in step c) the whole of the effluent containing fewer solid particles from step b) is sent to a section for treatment.

22. A process according to claim 21, in which the hydrocarbon feed is an atmospheric residue, a straight run vacuum residue, a vacuum residue from the conversion process, an oil deasphalted using a solvent, of propane, butane or pentane, an asphalt diluted by a hydrocarbon fraction of an LCO, an HCO, a DO, a VGO a slurry, or combinations thereof, the gas oil and vacuum gas oil obtained by straight run distillation and the various hydrocarbon fractions produced being capable of being recycled in mixtures in any proportions with the feeds cited above.

23. A process according to claim 21, in which a hydrocarbon fraction is added to the effluent from step b).

24. A process according to claim 21, in which at least a portion of the effluent obtained from step c) is sent to a distillation zone (step d) from which a gas fraction, a gasoline engine fuel fraction, a gas oil engine fuel fraction and a liquid fraction which is heavier than the gas oil fraction are recovered.

25. A process according to claim 24, in which the liquid fraction which is heavier than the gas oil fraction obtained from step d) is sent to a catalytic cracking section (step e) in which it is treated under conditions which produce a gas fraction, a gasoline fraction, a gas oil fraction and a slurry fraction.

26. A process according to claim 25, in which at least a portion of the gas oil fraction recovered in catalytic cracking step e) is recycled to step a) and/or step c).

27. A process according to claim 24, in which catalytic cracking step e) is carried out under conditions which produce a gasoline fraction at least a portion of which is sent to a fuel storage zone, a gas oil fraction at least a portion of which is sent to a gas oil storage zone and a slurry fraction at least a portion of which is sent to a heavy fuel storage zone.

28. A process according to claim 27, in which at least a portion of the gas oil fraction and/or the gasoline fraction obtained in catlytic cracking step e) is recycled to the inlet of the catalytic cracking section.

29. A process according to claim 25, in which at least a portion of the slurry fraction obtained in catalytic cracking step e) is recycled to the inlet of the catalytic cracking step.

30. A process according to claim 24, in which at least a portion of the liquid fraction which is heavier than the gas oil fraction obtained in step d) or f) is returned either to the hydroconversion of step a), or to the hydrotreatment step of c), or to each of these two sections.

31. A process according to claim 21, in which the step b comprises using at least two separation means in parallel one of which is used to carry out separation while the other is purged of retained fines.

32. A process according to claim 21, in which during step a) the treatment in the presence of hydrogen is carried out under an absolute pressure of 2.5 to 35 MPa, at a temperature of about 300EC to 550EC with an hourly space velocity of about to 0.1 to 10 $h^{-1}$ and the quantity of hydrogen mixed with the feed is about 50 to 5000 $Nm^3/m^3$.

33. A process according to claim 21, in which hydrotreatment step c) is carried out at an absolute pressure of about 2 to 35 MPa, at a temperature of about 300EC to 500EC with an hourly space velocity of about 0.1 to 5 $h^{-1}$ and the quantity of hydrogen mixed with the feed is about 100 to 5000 $Nm^3/m^3$.

34. A process according to claim 24, in which at least a portion of the heavier liquid fraction of hydrotreated feed obtained in step d) is sent to a heavy fuel storage zone.

35. A process according to claim 24, in which at least a portion of the gasoline engine fuel fraction and the gas oil engine fuel fraction obtained from step d) are sent to respective fuel storage zones.

36. A process according to claim 22, in which a hydrocarbon fraction is added to the effluent from step b).

37. A process according to claim 25, in which at least a portion of the gas oil fraction recovered in catalytic cracking step e) is recycled to step a) and step c).

38. A process according to claim 11, in which the hydrocarbon feed is an atmospheric residue, a straight run vacuum residue, a vacuum residue from the conversion process, an oil deasphalted using a solvent, of propane, butane or pentane, an asphalt diluted by a hydrocarbon fraction of an LCO, an HCO, a DO, a VGO a slurry, or combinations thereof, the gas oil and vacuum gas oil obtained by straight run distillation and the various hydrocarbon fractions produced being capable of being recycled in mixtures in any proportions with the feeds cited above.

39. A process according to claim 11, in which a hydrocarbon fraction is added to the effluent from step b).

40. A process according to claim 11, in which at least a portion of the effluent obtained from step c) is sent to a distillation zone (step d) from which a gas fraction, a gasoline engine fuel fraction, a gas oil engine fuel fraction and a liquid fraction which is heavier than the gas oil fraction are recovered.

41. A process according to claim 40, in which the liquid fraction which is heavier than the gas oil fraction obtained from step d) is sent to a catalytic cracking section (step e) in which it is treated under conditions which produce a gas fraction, a gasoline fraction, a gas oil fraction and a slurry fraction.

42. A process according to claim 41, in which at least a portion of the gas oil fraction recovered in catalytic cracking step e) is recycled to step a) and/or step c).

43. A process according to claim 40, in which catalytic cracking step e) is carried out under conditions which produce a gasoline fraction at least a portion of which is sent to a fuel storage zone, a gas oil fraction at least a portion of which is sent to a gas oil storage zone and a slurry fraction at least a portion of which is sent to a heavy fuel storage zone.

44. A process according to claim 41, in which at least a portion of the gas oil fraction and/or the gasoline fraction obtained in catalytic cracking step e) is recycled to the inlet of the catalytic cracking section.

45. A process according to claim 41, in which at least a portion of the slurry fraction obtained in catalytic cracking step e) is recycled to the inlet of the catalytic cracking step.

46. A process according to claim 40, in which at least a portion of the liquid fraction which is heavier than the gas oil fraction obtained in step d) or f) is returned either to the hydroconversion of step a), or to the hydrotreatment step of c), or to each of these two selections.

47. A process according to claim 11, in which the step b comprises using at least two separation means in parallel one of which is used to carry out separation while the other is purged of retained fines.

48. A process according to claim 11, in which during step a) the treatment in the presence of hydrogen is carried out under an absolute pressure of 2.5 to 35 MPa, at a temperature of about 300EC to 550EC with an hourly space velocity of about to 0.1 to 10 $h^{-1}$ and the quantity of hydrogen mixed with the feed is about 50 to 5000 $Nm^3/m^3$.

49. A process according to claim 11, in which hydrotreatment step c) is carried out at an absolute pressure of about 2 to 35 MPa, at a temperature of about 300EC to 500EC with an hourly space velocity of about 0.1 to 5 $h^{-1}$ and the quantity of hydrogen mixed with the feed is about 100 to 5000 $Nm^3/m^3$.

50. A process according to claim 40, in which at least a portion of the heavier liquid fraction of hydrotreated feed obtained in step d) is sent to a heavy fuel storage zone.

51. A process according to claim 40, in which at least a portion of the gasoline engine fuel fraction and the gas oil engine fuel fraction obtained from step d) are sent to respective fuel storage zones.

52. A process according to claim 38, in which a hydrocarbon fraction is added to the effluent from step b).

53. A process according to claim 41, in which at least a portion of the gas oil fraction recovered in catalytic cracking step e) is recycled to step a) and step c).

* * * * *